US009925474B1

(12) United States Patent
Sutton

(10) Patent No.: US 9,925,474 B1
(45) Date of Patent: Mar. 27, 2018

(54) TOY WITH CHANGEABLE FEATURES

(71) Applicant: Jay At Play International Hong Kong Limited, Kowloon (HK)

(72) Inventor: Joseph A. Sutton, West New York, NJ (US)

(73) Assignee: JAY AT PLAY INTERNATIONAL HONG KONG LIMITED, Kowloon (HK)

( * ) Notice: Subject to any disclaimer, the term of this patent is extended or adjusted under 35 U.S.C. 154(b) by 0 days.

(21) Appl. No.: 15/463,961

(22) Filed: Mar. 20, 2017

(51) Int. Cl.

| | |
|---|---|
| ***A63H 3/02*** | (2006.01) |
| ***A63H 33/00*** | (2006.01) |
| ***A63H 3/36*** | (2006.01) |
| ***A63H 3/12*** | (2006.01) |

(52) U.S. Cl.
CPC ..... *A63H 33/004* (2013.01); *A63H 3/02* (2013.01); *A63H 3/12* (2013.01); *A63H 3/36* (2013.01); *A63H 3/365* (2013.01)

(58) Field of Classification Search
CPC ..... A63H 33/004
See application file for complete search history.

(56) References Cited

U.S. PATENT DOCUMENTS

| | | | | |
|---|---|---|---|---|
| 1,396,766 | A | 11/1921 | McClelland | |
| 1,690,778 | A | 11/1928 | Ford | |
| 3,811,220 | A | 5/1974 | Glass | |
| 3,851,419 | A | 12/1974 | Kaelin | |
| 4,336,665 | A | 6/1982 | Moreau | |
| 4,614,505 | A | 9/1986 | Schneider et al. | |
| 4,695,264 | A | 9/1987 | McLeod, Jr. | |
| 4,921,459 | A | 5/1990 | Cook et al. | |
| 5,090,938 | A | 2/1992 | Reynolds | |
| 5,178,574 | A | 1/1993 | Evoy | |
| 5,649,848 | A * | 7/1997 | Clark | A63H 3/12 446/321 |
| 6,514,118 | B1 | 2/2003 | Bart et al. | |
| 6,962,517 | B2 | 11/2005 | Murray | |
| 2014/0220851 | A1 | 8/2014 | Bennett | |
| 2015/0314205 | A1 | 11/2015 | Rebella et al. | |

FOREIGN PATENT DOCUMENTS

| | | | |
|---|---|---|---|
| WO | 2015195481 | A1 | 12/2015 |

OTHER PUBLICATIONS

Plushiemorphs—Transforming Toys Powered by Pure Imagination, known and accessible to the public at least as early as Mar. 8, 2017, retrieved from the Internet at https://plushiemorphs.com/products-2/, 5 pages and a Statement of Relevance.

* cited by examiner

*Primary Examiner* — Michael Dennis
(74) *Attorney, Agent, or Firm* — Michael Best & Friedrich LLP

(57) ABSTRACT

A toy includes a body and a first flap coupled to the body movable between a first position, in which a first surface of the first flap is visible, and a second position, in which a second opposite surface of the first flap is visible. The toy also includes a second flap coupled to the body movable between a first position, in which a first surface of the second flap is visible, and a second position, in which a second opposite surface of the second flap is visible. When the first and second flaps are both in the first positions, the toy defines a first configuration, and when the first and second flaps are both in the second positions, the toy defines a second configuration different in appearance from the first configuration.

24 Claims, 12 Drawing Sheets

TOY WITH CHANGEABLE FEATURES

BACKGROUND

The present invention relates to toys, and in particular to toys that display images of characters or objects.

Toys that display an image of a character or object (e.g., of a character's head or full body including the head) come in a variety of forms, including dolls, figurines, etc.

SUMMARY

In accordance with one embodiment, a toy includes a body and a first flap coupled to the body movable between a first position, in which a first surface of the first flap is visible, and a second position, in which a second opposite surface of the first flap is visible. The toy also includes a second flap coupled to the body movable between a first position, in which a first surface of the second flap is visible, and a second position, in which a second opposite surface of the second flap is visible. When the first and second flaps are both in the first positions, the toy defines a first configuration, and when the first and second flaps are both in the second positions, the toy defines a second configuration different in appearance from the first configuration.

In accordance with another embodiment, a toy includes a first portion having a first flap that defines a portion of a first image in a first configuration, and a first underlying surface beneath the first flap that defines a portion of a second image in a second configuration. The toy also includes a second portion having a second flap that defines a portion of the first image in the first configuration, and a second underlying surface beneath the second flap that defines a portion of the second image in the second configuration. The second configuration has a different appearance from the first configuration.

In accordance with another embodiment, a toy includes a body, and a first flap coupled to the body and having a first surface defining a portion of a first configuration. The first flap also has a second surface opposite the first surface and defining a portion of a second configuration, the second configuration having a different appearance from the first configuration. The toy also includes a second flap coupled to the body and having a third surface defining a portion of the first configuration. The second flap also has a fourth surface opposite the third surface and defining a portion of the second configuration. A first underlying surface of the body is beneath the first flap and defines a portion of the second configuration. A second underlying surface of the body is beneath the second flap and defines a portion of the second configuration. The first flap is moveable from a first position in the first configuration, in which the first surface of the first flap is revealed to view and the second surface opposite the first surface is hidden from view, to a second position in the second configuration, in which the second surface of the first flap is revealed to view and the first surface of the first flap is hidden from view. The second flap is moveable from a first position in the first configuration, in which the third surface of the second flap is revealed to view and the fourth surface of the second flap is hidden from view, to a second position in the second configuration, in which the fourth surface of the second flap is revealed to view and the third surface of the second flap is hidden from view.

Other aspects of the invention will become apparent by consideration of the detailed description and accompanying drawings.

Figure 1:
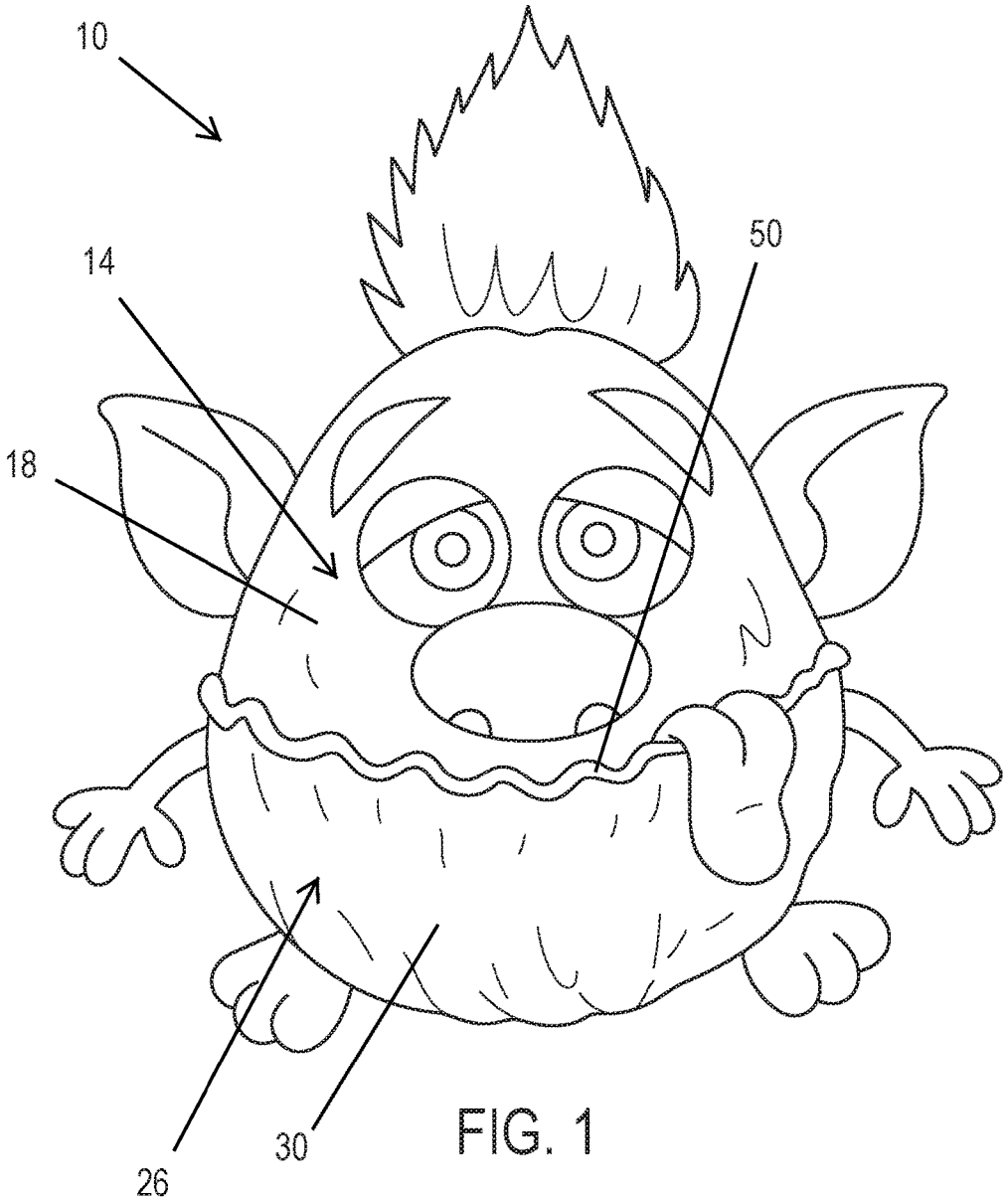
FIG. 1 is front view of a toy according to one embodiment, the toy being in a first configuration.

Before any embodiments of the invention are explained in detail, it is to be understood that the invention is not limited in its application to the details of embodiment and the arrangement of components set forth in the following description or illustrated in the following drawings. Use of relative terms such as "right," "left," "front side," "backside," "lower," "upper," "over," "under," "up," "down," "top," and "bottom," as well as derivatives of such terms (e.g., "downwardly" and "upwardly") should be construed to refer to exemplary orientation as then described or as shown in the drawing under discussion. These relative terms are for convenience of description and do not require that the apparatus be constructed or operated in a particular orientation. The invention is capable of other embodiments and of being practiced or of being carried out in various ways. Also, it is to be understood that the phraseology and terminology used herein is for the purpose of description and should not be regarded as limiting in nature.

DETAILED DESCRIPTION

FIGS. 1-12 illustrate toys that are changeable (e.g., convertible or reconfigurable) between at least two configurations in which a first configuration displays a first image, design, character or object, and a second configuration displays a second different image, design, character or object. The images or characters that may be displayed include, for example, commonly known movie or television characters, animated characters, animals, humans, inanimate objects, fantasy creatures or characters, historical characters, characters from books or other sources, or other articles, whether real or imagined. The objects that may be displayed include, for example, globes, maps, or other objects (e.g., objects that may appeal to a child as a toy or may be educational in nature). The materials used to form the first and second characters and objects may be any suitable materials, including plush fabric, knit fabric, woven fabric, plastic, rubber, or any other suitable material for use as a toy.

For purposes of illustration, a reconfigurable "troll creature" will be described as an exemplary embodiment of the toy.

FIGS. 1-6 illustrate a toy 10 that can be changed or reconfigured between two configurations that display or portray different designs, images characters, or objects. A first flap 14 coupled to the body 12 is moveable between at least two different positions to change which character or object is displayed. In the illustrated embodiment, the first flap 14 includes a first surface 18 (FIGS. 1-2) defining a portion, for example, an upper portion, of the front side of a first character or object (e.g., in the illustrated embodiment a first troll creature made of plush fabric), and a second surface 22 (FIGS. 3-5) defining a portion, for example, an upper portion, of the backside of a second character or object (e.g., in the illustrated embodiment a second troll creature made of plush fabric). The first and second surfaces 18, 22 of the first flap 14 are opposite surfaces of the first flap 14, and as illustrated in FIGS. 1-6 form the interior and exterior surfaces of the flap, depending upon the position of the first flap 14 on the body 12.

The toy 10 further includes a second flap 26 coupled to the body 12 that is movable between at least two different positions to change which character or object is displayed. In the illustrated embodiment, the second flap 26 includes a first surface 30 (FIGS. 1-3) defining a portion, for example, a lower bottom portion, of the front side of the first character or object (e.g., in the illustrated embodiment the first troll creature), and a second surface 34 (FIGS. 4-5) defining a portion, for example, a lower bottom portion, of the backside of the second character or object (e.g., in the illustrated embodiment the second troll creature). The first and second surfaces 30, 34 of the second flap 26 are opposite surfaces on the second flap 26, and as illustrated in FIGS. 1-6 form the internal and external surfaces of the flap, depending upon the position of the second flap 26 on the body 12.

Figure 2:
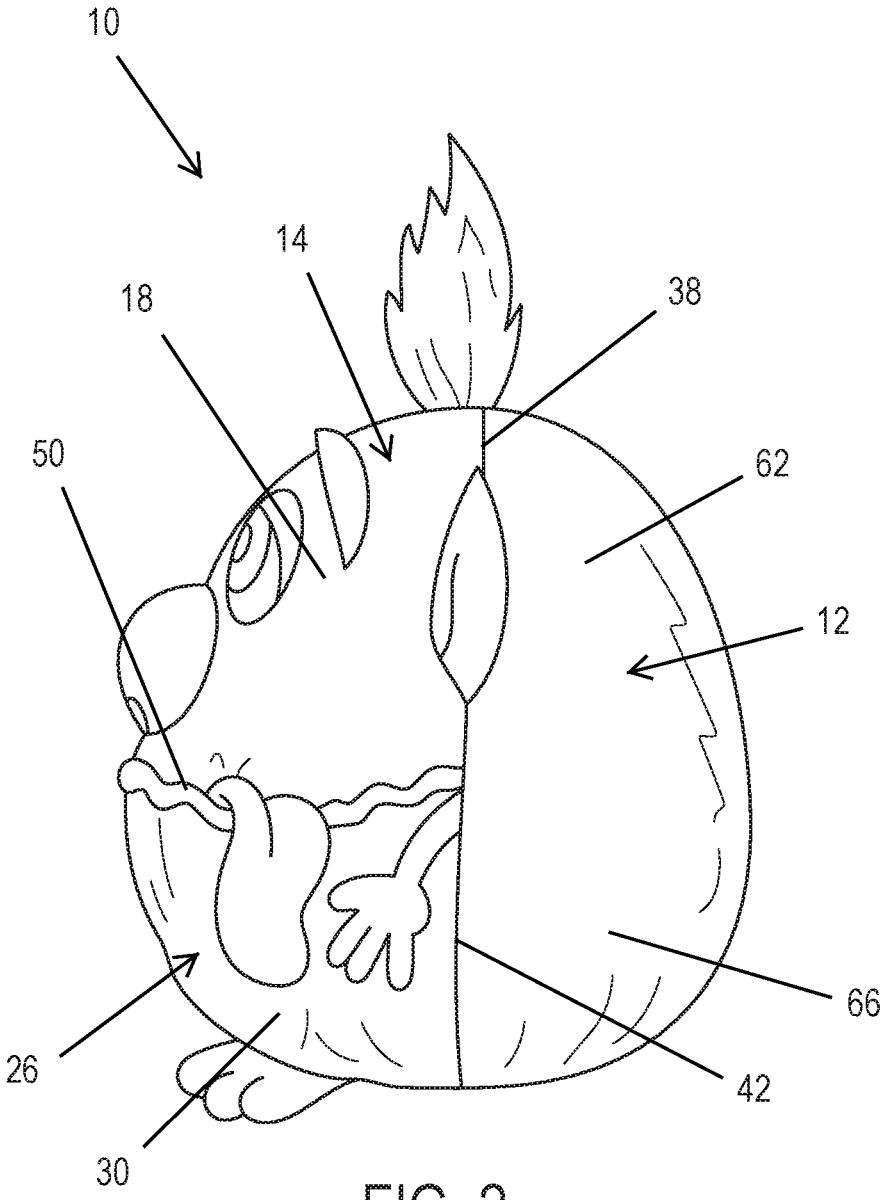
FIG. 2 is a side view of the toy in the first configuration.

With reference to FIGS. 1 and 2, the exemplary embodiment of the toy 10 includes a first configuration in which the first surface 18 of the first flap 14 is an outer, visible surface on the toy 10, and the second surface 22 of the first flap 14 is hidden from view underneath the visible first surface 18. In the illustrated embodiment the first surface 18 of the first flap 14 includes, for example, eyes, eyebrows, and a nose of the first troll creature.

With continued reference to FIGS. 1 and 2, in the first configuration the first surface 30 of the second flap 26 is an outer, visible surface on the toy 10, and the second surface 34 of the second flap 26 is hidden from view underneath the visible first surface 30. In the illustrated embodiment the first surface 30 of the second flap 26 includes for example a lower jaw, body portion, and feet of the first troll creature.

With reference to FIG. 2, the first flap 14 is coupled (e.g., via stitching, adhesives, fasteners, etc.) to the body 12 along a first seam 38. In the illustrated embodiment the first seam 38 extends from one side of the first troll creature's head, upwardly from about the midsection of the body 12 past an ear of the troll creature, and over the top of the troll creature's head to an opposite side of the troll creature's head. The second flap 26 is coupled (e.g., via stitching, adhesives, fasteners, etc.) to the body 12 along a separate, second seam 42. In the illustrated embodiment the second seam 42 extends from a side of the first troll creature's lower jaw and body, down from about the midsection of the body 12 along a bottom of the troll creature's lower body, and up along an opposite side of the troll creature's lower body. The first seam 38 and the second seam 42 together form an overall seam that extends entirely around the body 12 of the toy 10, such that the first troll creature's face, arms, and feet are displayed on one side of the first and second seams 38, 42 in the first configuration (i.e., a front side to the left of the seams 38, 42 in FIG. 2). A backside of the first troll creature is displayed relative to the first and second seams 38, 42 opposite the front side in the first configuration (i.e., to the right of the seams 38, 42 in FIG. 2).

Figure 3:
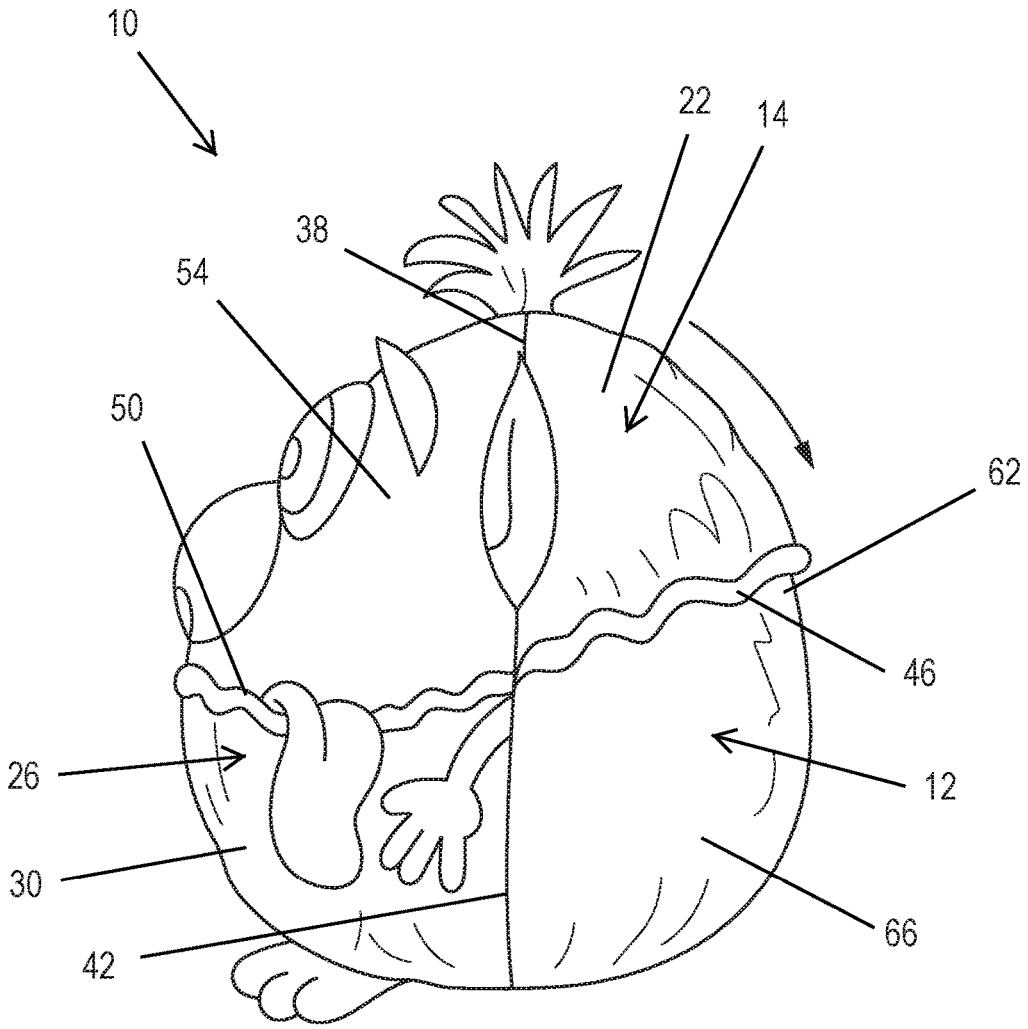
FIG. 3 is a side view of the toy, illustrating a first flap of the toy being moved from the first configuration to the second configuration.

With reference to FIGS. 1-6, the first flap 14 includes a first edge 46 (FIGS. 3-4) and the second flap 26 includes a second edge 50 (FIGS. 1-5). The first flap 14 is moveable (e.g., rotatable) about the first seam 38 from the first configuration illustrated in FIGS. 1 and 2 (where in the illustrated embodiment the first edge 46 is tucked directly under the second edge 50 on the front side of the body 12), to a second configuration illustrated in FIGS. 5 and 6 (where in the illustrated embodiment the first edge 46 is again tucked directly under the second edge 50 on the backside of the body 12). FIG. 3 illustrates an intermediate position of the first flap 14 as the first flap is being moved from the first configuration to the second configuration. That is, a user can grasp the first edge 46 of the first flap 14 and pull the flap over the top of the body 12 from its position in the first configuration to uncover the upper portion of the front side of the body and to cover the upper portion of the backside of the body to place the flap 14 in the second configuration.

The first flap 14 is thus arranged to move and rotate about the first seam 38 such that in the second configuration the second surface 22 of the first flap 14 is revealed to view along the backside of the body 12, and the first surface 18 of the first flap 14 is hidden from view. In the illustrated embodiment, the second surface 22 of the first flap 14 defines an upper portion of the backside of the second troll creature. In some embodiments, the first edge 46 includes an elastic material that may easily be stretched and pulled to facilitate rotation of the first edge 46 from the first configuration to the second configuration. Additionally, the elastic material may also help to hold the first edge 46 in place on the body 12 in one or both of the first and second configurations. In the illustrated embodiment, the first edge 46 is a lip of the mouth of the first troll creature.

Figure 4:
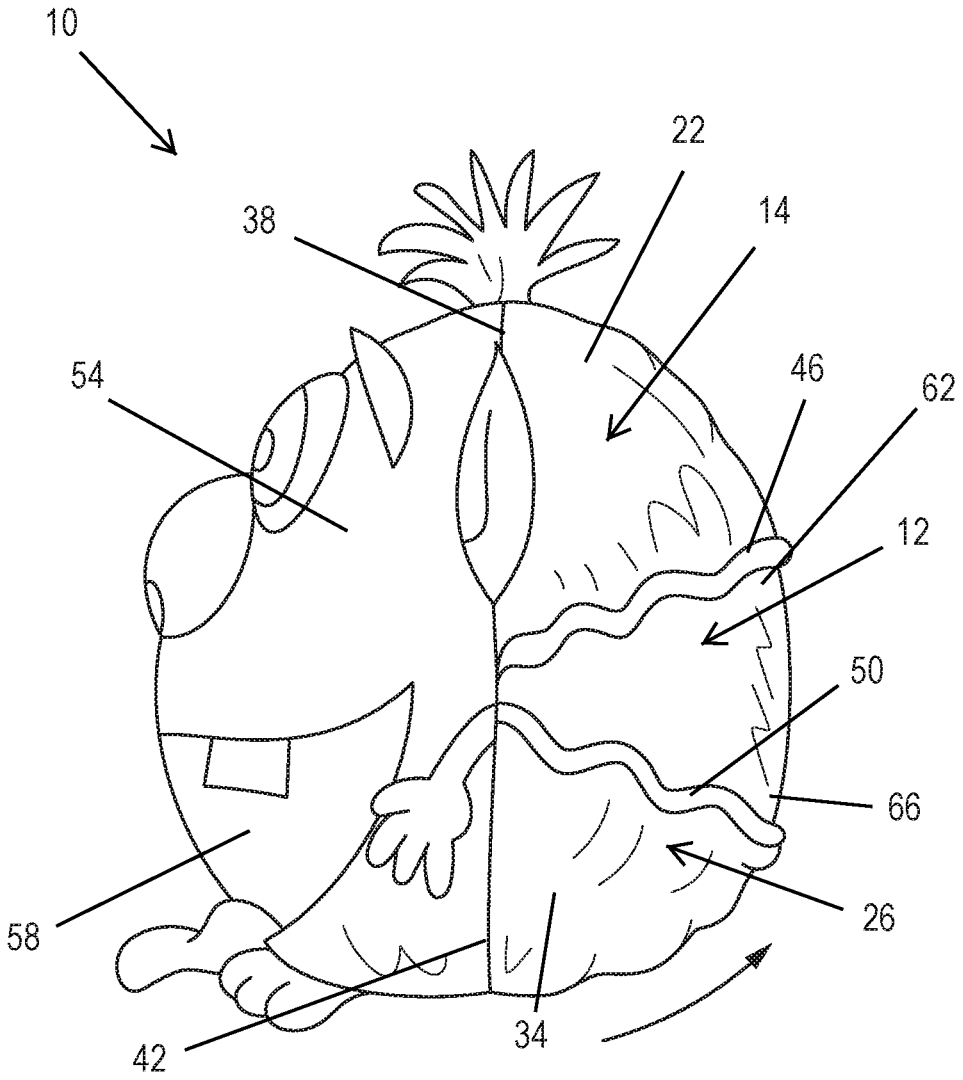
FIG. 4 is a side view of the toy, illustrating a second flap of the toy being moved from the first configuration to the second configuration.
Figure 5:
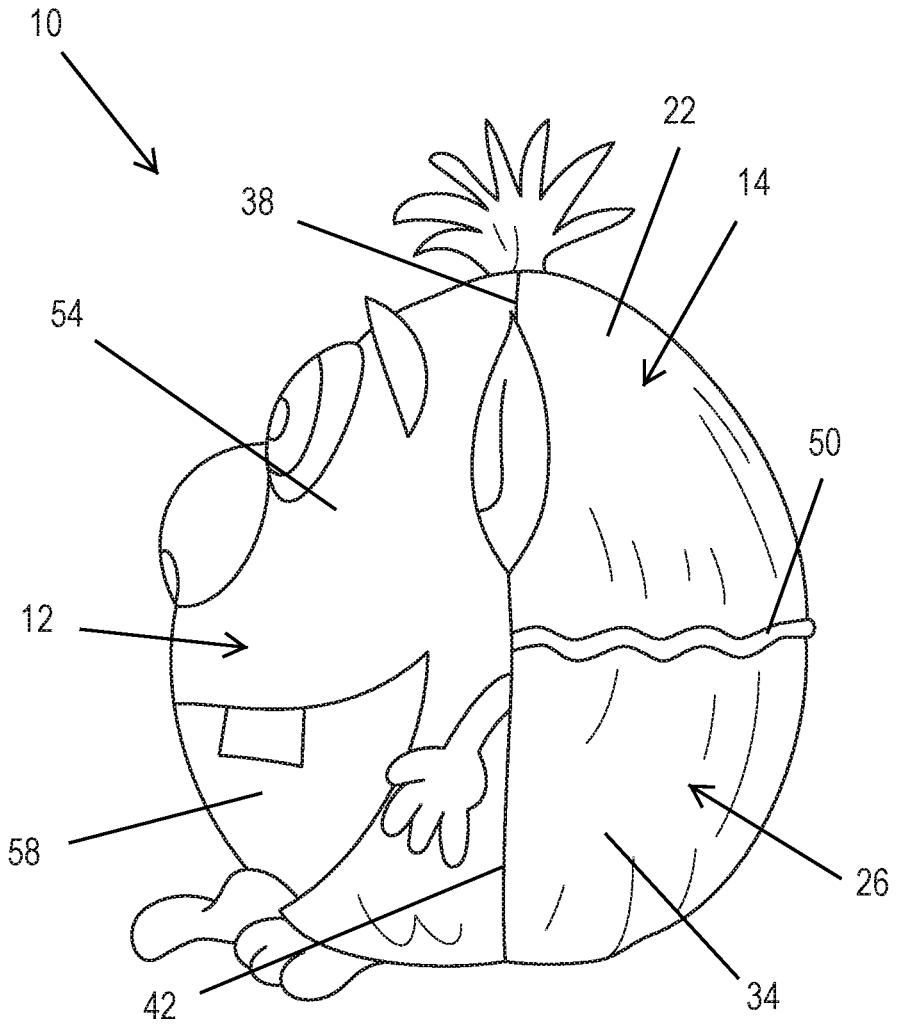
FIG. 5 is a side view of the toy in the second configuration.
Figure 6:
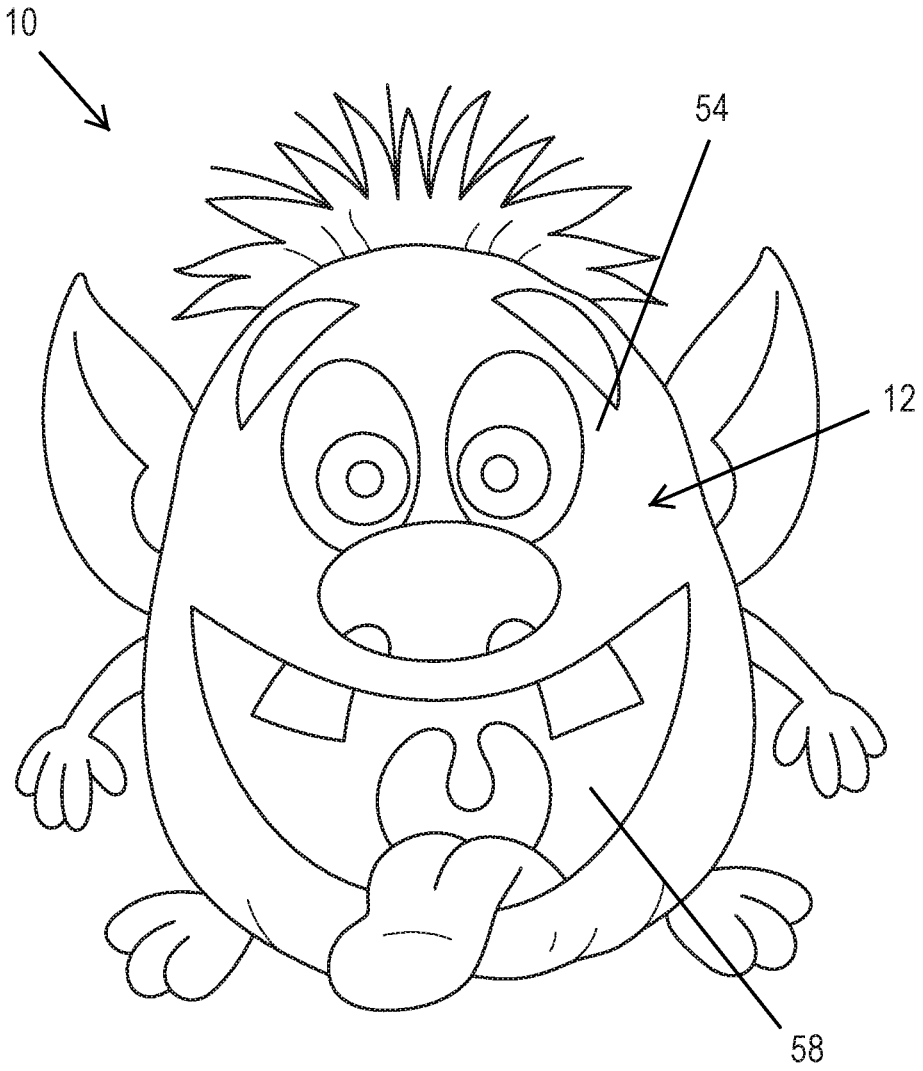
FIG. 6 is a front view of the toy in the second configuration.

With continued reference to FIGS. 1-6, the second flap 26 is moveable (e.g., rotatable) about the second seam 42 under the bottom portion of the body 12 in a manner similar to that described with respect to the movement of the first flap 14 from the first configuration illustrated in FIGS. 1 and 2, to the second configuration illustrated in FIGS. 5 and 6. FIG. 4 illustrates an intermediate position of the second flap 26 as the second flap 26 is being moved from the first configuration to the second configuration. The second flap 26 is arranged to move and rotate about the second seam 42, such that in the second configuration the second surface 34 of the second flap 26 is revealed to view along the backside of the body 12, and the first surface 30 of the second flap 26 is hidden from view. In the illustrated embodiment, the second surface 34 of the second flap 26 defines a lower portion of the backside of the second troll creature. That is, a user can grasp the second edge 50 of the second flap 26 and pull the flap under the bottom of the body 12 from its position in the first configuration to uncover the lower portion of the front side of the body 12 and to cover the lower portion of the backside of the body 12 to place the flap 26 in the second configuration.

In some embodiments, the second edge 50 includes an elastic material that may easily be stretched and pulled to facilitate rotation of the second edge 50 from the first configuration to the second configuration. Additionally, the elastic material may also help to hold the second edge 50 in place on the body 12 in one or both of the first and second configurations. In the illustrated embodiment, the second edge 50 is a lip on the mouth of the first troll creature.

With continued reference to FIGS. 1-6, the first edge 46 of the first flap 14 and the second edge 50 of the second flap 26 are adjacent one another (e.g., in contact with one another, slightly overlapping and tucked under one another, and/or otherwise in close proximity to one another) when the toy 10 is in the first configuration, as well as in the second configuration. Thus, to change the toy 10 from the first configuration to the second configuration, the first flap 14 is rotated in a first rotational direction (e.g., clockwise) about the first seam 38, and the second flap 26 is rotated in a second, opposite rotational direction (e.g., counterclockwise) about the second seam 42. To change the toy 10 back from the second configuration to the first configuration, the first flap 14 is rotated back about the first seam 38 (e.g., counterclockwise), and the second flap 26 is rotated back about the second seam 42 (e.g. clockwise).

In other embodiments, the first flap 14 may be positioned on one side of the toy 10 and the second flap 26 may be positioned on an opposite side of the toy 10 in both the first and the second configurations. Thus, to change the toy 10 from the first configuration to the second configuration, the first flap 14 is rotated in a first rotational direction (e.g., clockwise) about the first seam 38, and the second flap 26 is also rotated in the first rotational direction (e.g., clockwise) about the second seam 42. To change the toy 10 back from the second configuration to the first configuration, the first flap 14 is rotated back about the first seam 38 (e.g., counterclockwise), and the second flap 26 is rotated back about the second seam 42 (e.g. counterclockwise).

In yet other embodiments, the first edge 46 of the first flap 14 may be spaced from the second edge 50 of the second flap 26 in the first configuration and/or the second configuration, such that a portion (e.g., mid-section or other region) of the second character or object is visible at all times both in the first configuration and the second configuration. In such embodiments, the first flap 14 may still be rotated in a first rotational direction and the second flap 26 may be rotated in an opposite rotational direction to fully convert between the two characters or objects, or the first flap 14 and the second flap 26 may be rotated in the same rotational direction to fully convert between the two characters or objects.

With reference to FIGS. 3-6, the body 12 of toy 10 includes a first underlying upper surface 54 (e.g., on the upper portion of the front side of the body 12) that is covered from view underneath the first flap 14 when the toy 10 is in the first configuration, and is revealed to view when the toy 10 is in the second configuration (FIGS. 5 and 6). The first underlying upper surface 54 defines the upper portion of the front side of the second character or object. In the illustrated embodiment, the first underlying upper surface 54 defines a portion of a head of the second troll creature, and includes, for example, eyes, eyebrows, and a nose of the second troll creature.

With reference to the second configuration shown in FIGS. 4-6, the toy 10 includes a second underlying lower surface 58 (e.g., on a lower portion on the front side) on the body 12 that is covered from view underneath the second flap 26 when the toy 10 is in the first configuration, and is revealed to view when the toy 10 is in the second configuration. The second underlying lower surface 58 thus defines a lower portion of the front side of the second character or object. In the illustrated embodiment, the second underlying lower surface 58 defines a lower portion of the head and a body of the second troll creature, and includes, for example, a mouth and feet of the second troll creature.

With reference to FIGS. 2-4, the toy 10 further includes a third underlying upper surface 62 on the backside of the body 12 that is revealed to view when the toy 10 is in the first configuration, and is covered from view when the toy 10 is in the second configuration. The third underlying upper surface 62 defines an upper portion of the first character or object. In the illustrated embodiment, the third underlying lower surface 62 defines a rear, upper portion of the first troll creature's head.

With continued reference to FIGS. 2-4, the toy 10 also includes a fourth underlying lower surface 66 on the backside of the body 12 that is revealed to view when the toy 10 is in the first configuration, and is covered from view when the toy 10 is in the second configuration. The fourth underlying lower surface 66 defines a lower portion of the first character or object. In the illustrated embodiment, the fourth underlying lower surface 66 defines a rear, lower portion of the first troll creature's head and body.

As illustrated in FIG. 3, when the first flap 14 is rotated over the first seam 38, the first underlying upper surface 54 is uncovered and revealed to view, and the first flap 14 begins to cover from view the third underlying upper surface 62. Similarly, and as illustrated in FIG. 4, when the second flap 26 is rotated over the second seam 42, the second underlying lower surface 58 is uncovered and revealed to view, and the second flap 26 begins to cover from view the fourth underlying lower surface 66.

In the illustrated embodiment, the first and second troll creatures are both oriented in an upright configuration, as illustrated in FIGS. 1-6. In other embodiments, the characters or objects may be oriented opposite to one another. For example, the first visible surface 18 of the first flap 14 may correspond to the head of the first troll creature (e.g., including eyes), and the first underlying surface 54 may correspond to the lower body of the second troll creature (e.g., including feet). Similarly, the first visible surface 30 of the second flap 26 may correspond to the lower body of the first troll creature (e.g., including feet), and the second underlying surface 58 may correspond to the head of the second troll creature (e.g., including eyes). Thus, when the first flap 14 and the second flap 26 are rotated about their corresponding first and second seams 38, 42, the upright first troll creature may transform into a second troll creature that is oriented upside-down relative to the first troll creature.

Various other embodiments include first and second flaps that display portions of heads, upper bodies, lower bodies, etc., or combinations thereof. Thus, in some embodiments the first flap may include a portion of a head of a first character, and the second flap may include another portion of the same head of the first character. In some embodiments, the outer surface of the first flap and the first underlying upper surface may include only a face or a body, and the outer surface of the second flap and the second underlying lower surface may include only a body or a face.

Figure 7:
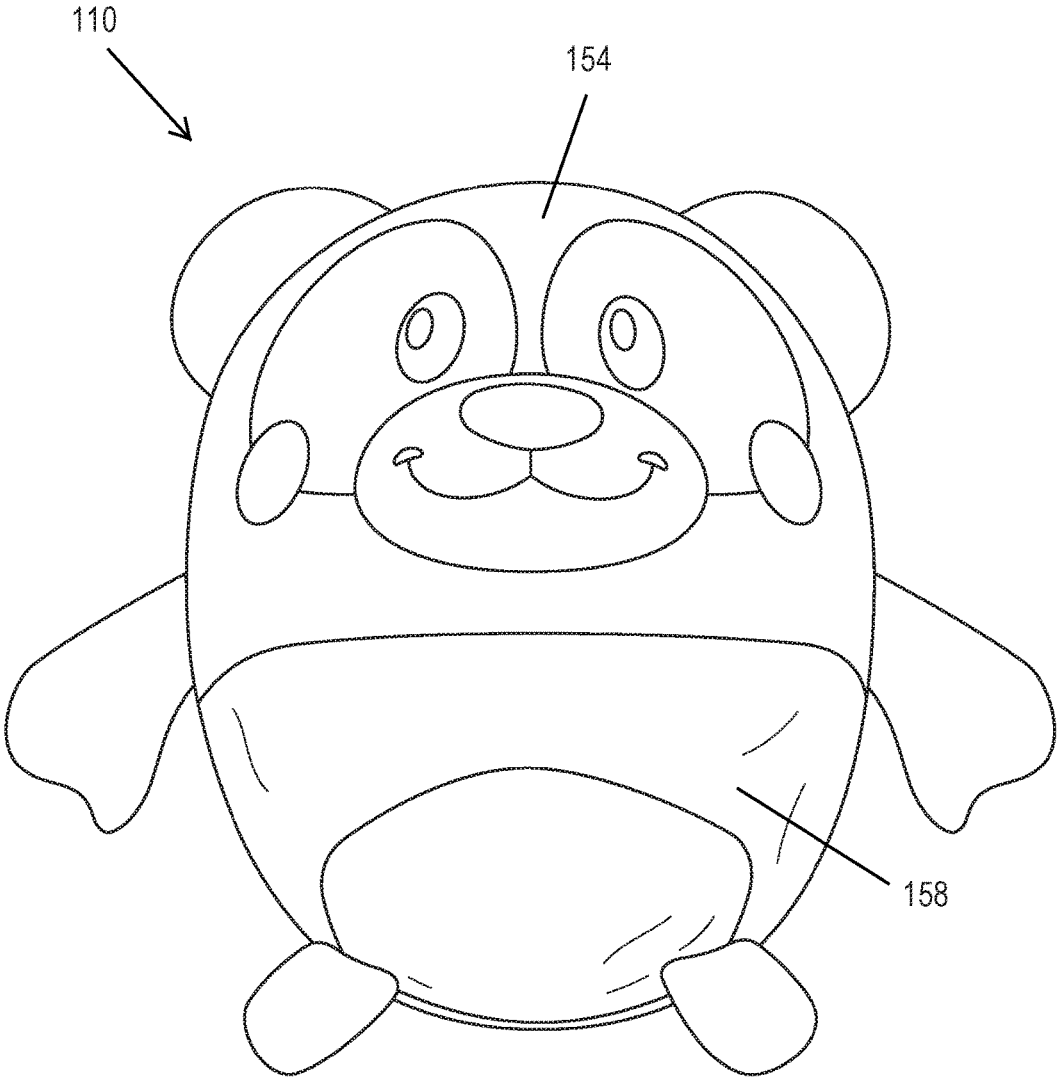
FIG. 7 is a front view of a toy according to another embodiment, the toy being in a second configuration.
Figure 8:
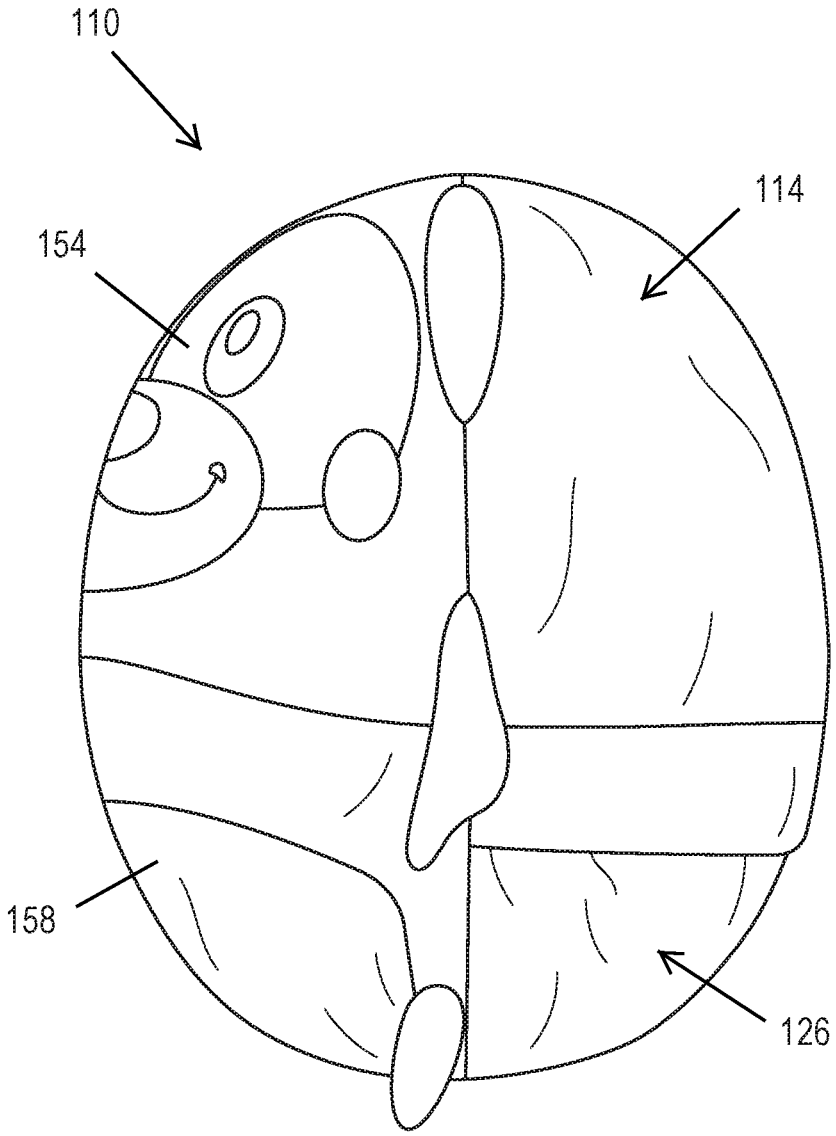
FIG. 8 is a side view of the toy of FIG. 8 in the second configuration.
Figure 9:
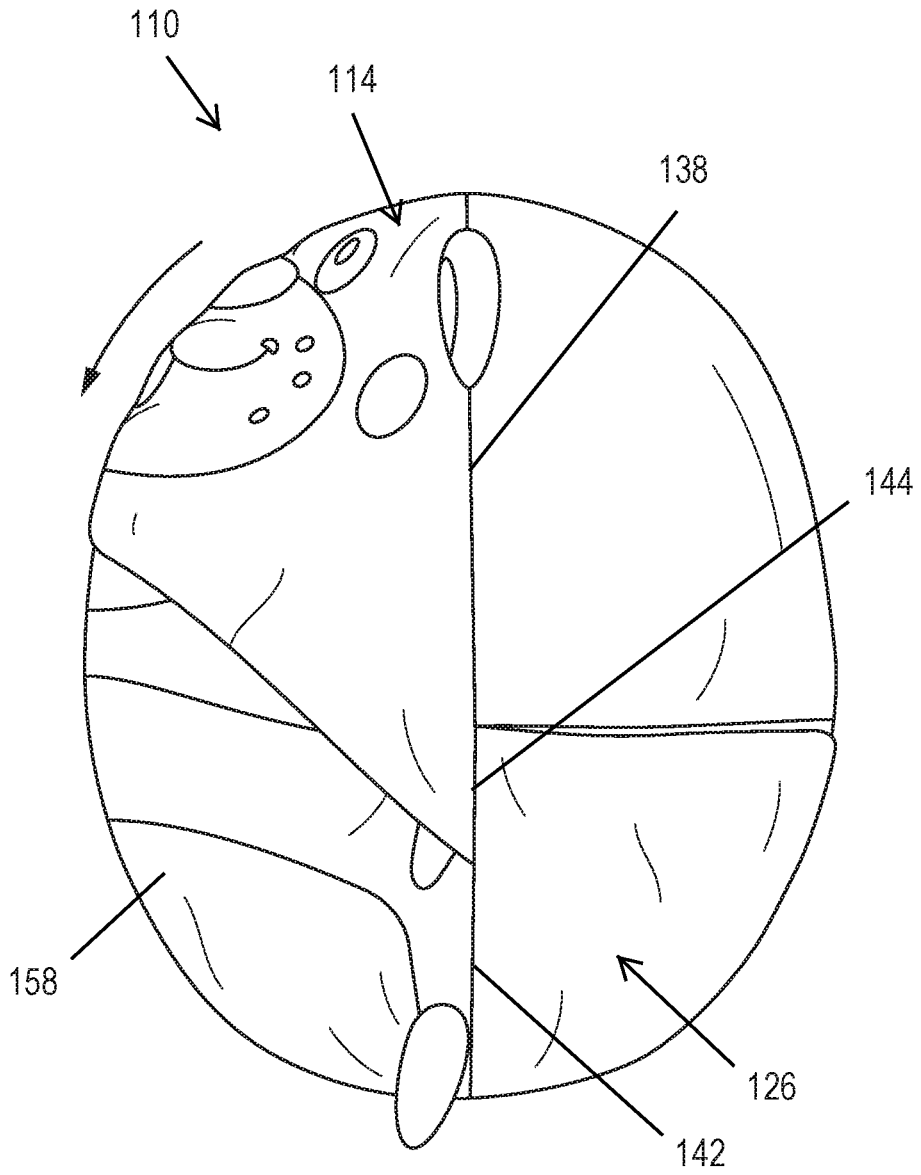
FIG. 9 is a side view of the toy of FIG. 8, illustrating a first flap of the toy being moved from the second configuration to the first configuration.
Figure 10:
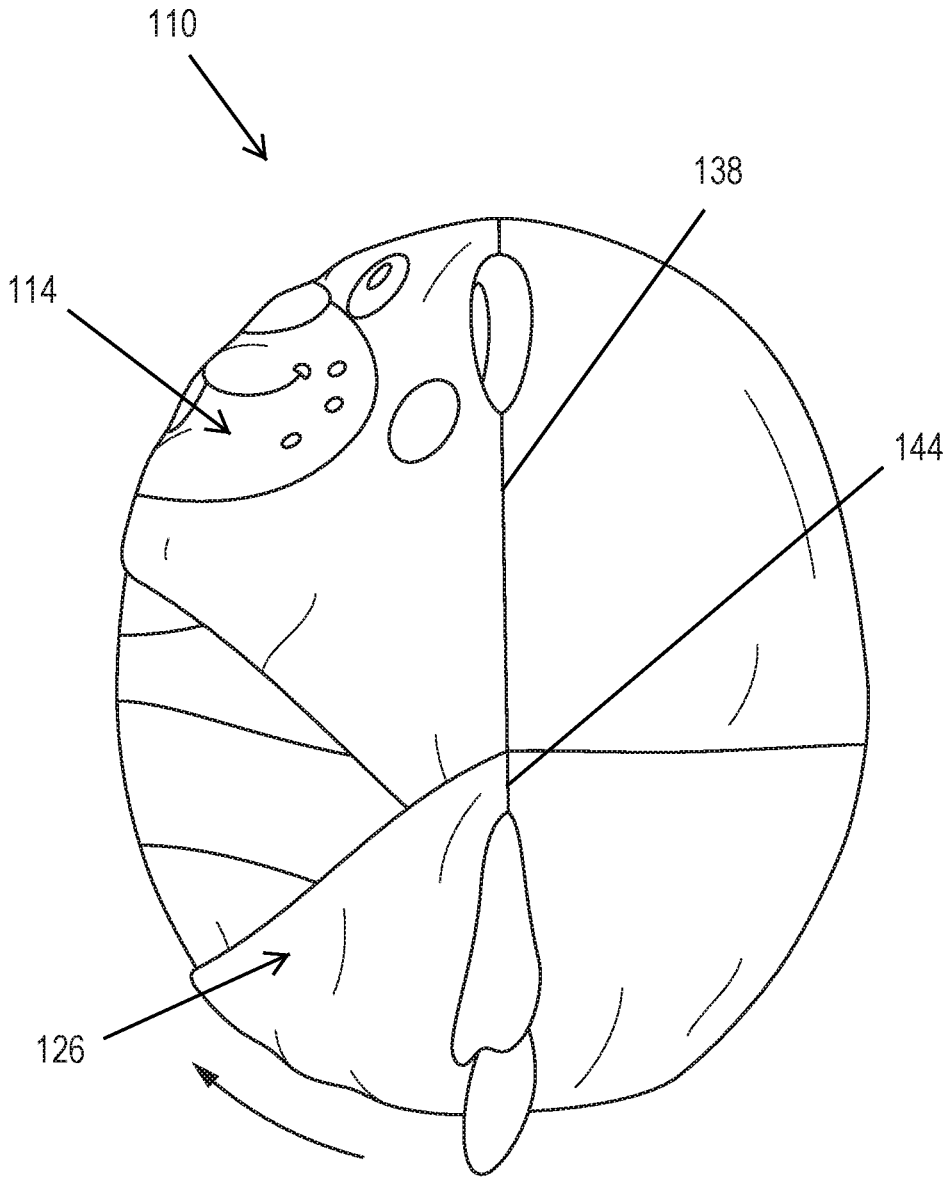
FIG. 10 is a side view of the toy of FIG. 8, illustrating a second flap of the toy being moved from the second configuration to the first configuration.
Figure 11:
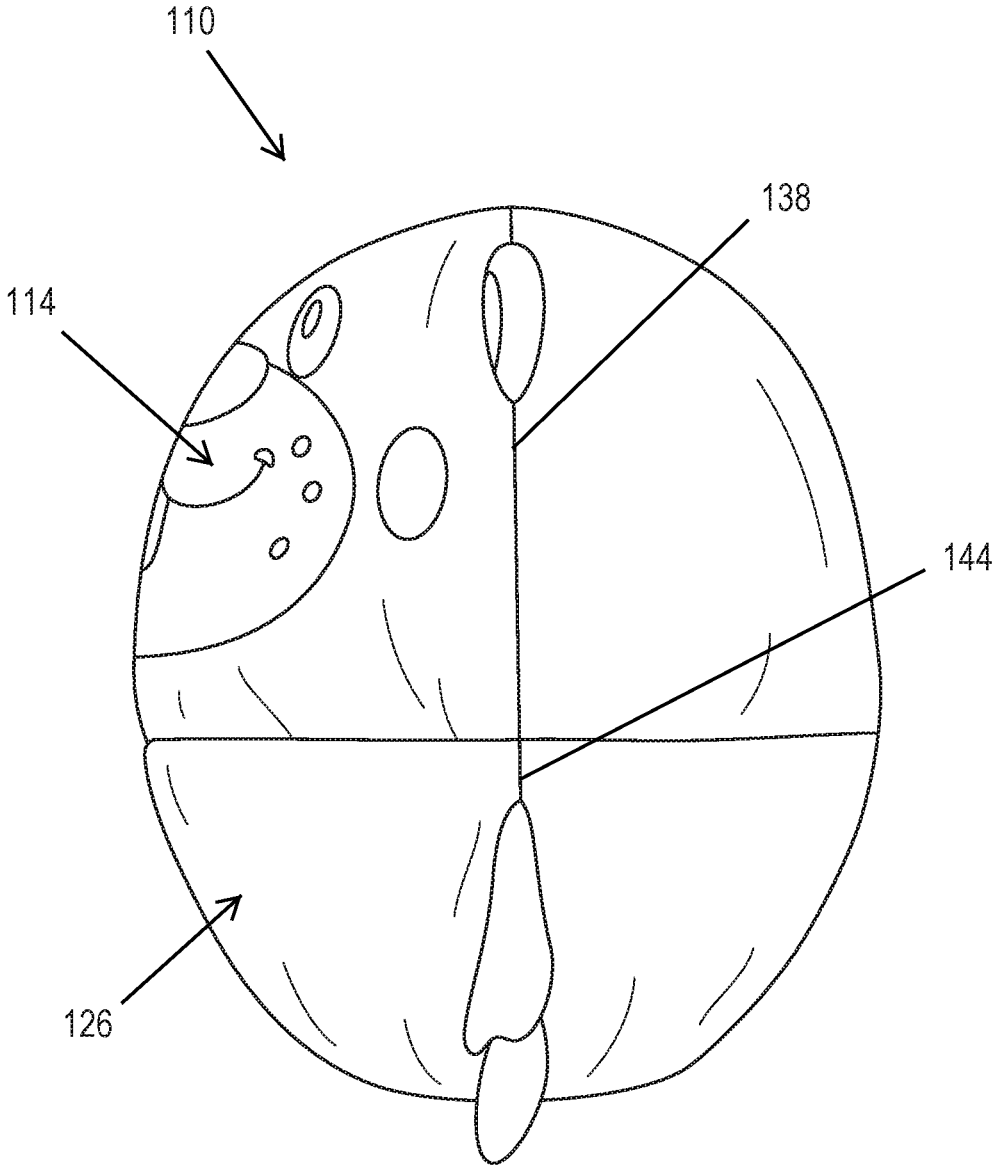
FIG. 11 is a side view of the toy of FIG. 8, in the first configuration.
Figure 12:
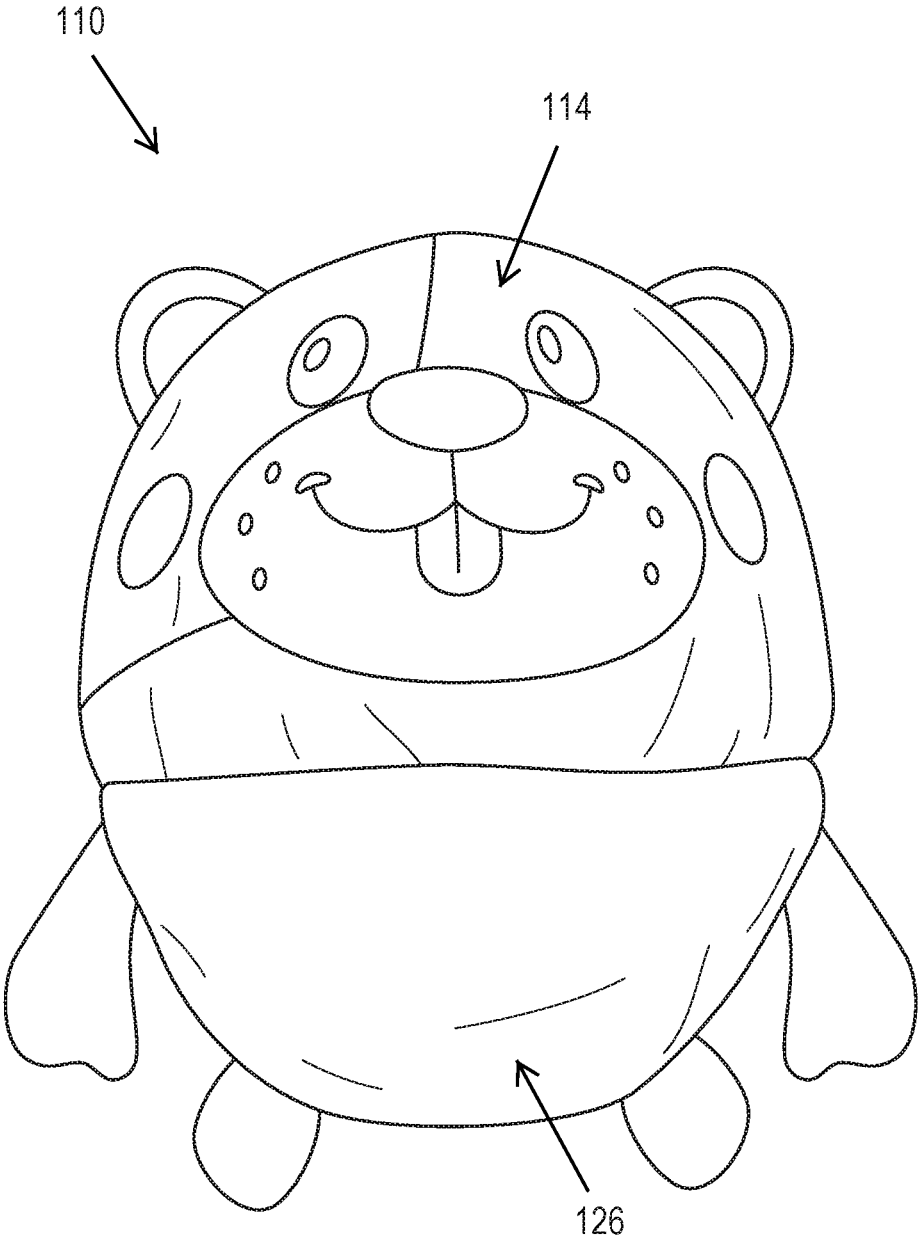
FIG. 12 is a front view of the toy of FIG. 8, in the first configuration.

In some embodiments, the first flap and the second flap overlap one another. For example, FIGS. 7-12 illustrate a toy 110 that includes a first flap 114 and a second flap 126 (FIGS. 8-12) that are each moveable between at least two different positions to change which character or object is displayed (e.g., in the illustrated embodiment a panda and a dog). The toy 110 operates in the same manner as the toy 10 (i.e., moving the first and second flaps 114, 126 about a first seam 138 and a second seam 142, respectively, to change which character is displayed). One configuration (i.e., second configuration) is illustrated in FIGS. 7 and 8, and the other configuration (i.e., first configuration) is illustrated in FIGS. 11 and 12, with a first upper underlying surface 154 and second lower underlying surface 158 both visible in FIGS. 7 and 8, and hidden from view in FIGS. 11 and 12.

The first and second seams 138, 142 may overlap in a central region 144. Thus, as illustrated in FIGS. 9 and 10, the first flap 114 and the second flap 126 overlap one another in part during a transition between the two characters. Other embodiments may include a smaller or larger overlap than that illustrated.

Additionally, the embodiment of FIGS. 7-12 illustrates an example of a first flap 114 and a first upper underlying surface 154 that each generally corresponds to a face of the first and second character, and a second flap 126 and a second lower underlying surface 158 that each generally corresponds to a body of the first and second character. As noted above, however, various other embodiments include different arrangements of character regions (e.g., face, body, etc.).

In some embodiments, the toy 10 is large enough for a child to sit or lie on. For example, the toy 10 may be a bean bag chair or be filled with material that provides a comfortable surface to sit or lie on. When the toy 10 is sized for use as a bean bag chair, it can be filled with beans or similar material commonly used for bean bag chairs.

Additionally, while the illustrated embodiments include only two flaps, other embodiments may include different numbers of flaps. For example, in some embodiments the toy may include just a single flap that rotates about a seam on the toy. In yet other embodiments, the toy may include three or more flaps that rotate about one or more seams so as to reveal and hide various characters or objects as desired.

Although the invention has been described in detail with reference to certain preferred embodiments, variations and modifications exist within the scope and spirit of one or more independent aspects of the invention as described.

Various features and advantages of the invention are set forth in the following claims.

The invention claimed is:

1. A toy comprising:

a body;

a first flap coupled to the body along a first seam and rotatable about the first seam between a first position, in which a first surface of the first flap is visible, and a second position, in which a second opposite surface of the first flap is visible; and a second flap coupled to the body along a second seam and rotatable about the second seam between a first position, in which a first surface of the second flap is visible, and a second position, in which a second opposite surface of the second flap is visible, wherein when the first and second flaps are both in the first positions, the toy defines a first configuration, and when the first and second flaps are both in the second positions, the toy defines a second configuration different in appearance from the first configuration.

2. The toy of claim 1, wherein the first flap includes a first edge of elastic material, and the second flap includes a second edge of elastic material.

3. The toy of claim 1, wherein the first flap is rotatable about the first seam in a first direction from the first position to the second position and the second flap is rotatable about the second seam in a second direction opposite to the first direction from the first position to the second position.

4. The toy of claim 3, wherein the first direction is a first rotational direction, and the second direction is a second rotational direction.

5. The toy of claim 1, wherein the first flap defines a first portion of the first configuration, and the second flap defines a second portion of the first configuration.

6. The toy of claim 1, wherein the first surface of the first flap defines a head portion of the first configuration, and the first surface of the second flap defines a lower body portion of the first configuration.

7. The toy of claim 1, wherein the body comprises a first underlying surface beneath the first flap when the first flap is in the first position and a second underlying surface beneath the second flap when the second flap is in the first position, wherein the first underlying surface defines a first portion of the second configuration and the second underlying surface defines a second portion of the second configuration.

8. The toy of claim 1, wherein the first configuration represents a first image and the second configuration represents a second image that is different in appearance from the first image.

9. A toy comprising:

a first portion having a first flap that defines a portion of a first image in a first configuration, and a first underlying surface beneath the first flap that defines a portion of a second image in a second configuration; and a second portion having a second flap that defines a portion of the first image in the first configuration, and a second underlying surface beneath the second flap that defines a portion of the second image in the second configuration;

wherein the second configuration has a different appearance from the first configuration;

wherein the first flap is coupled to the first portion along a first seam and is rotatable about the first seam to change between the first configuration and the second configuration; and wherein the second flap is coupled to the second portion along a second seam and is rotatable about the second seam to change between the first configuration and the second configuration.

10. The toy of claim 9, wherein the first flap moves in a first direction to reveal to view the first underlying surface, and the second flap moves in an opposite direction to the first direction to reveal to view the second underlying surface.

11. The toy of claim 10, wherein the first direction is a first rotational direction, and the second direction is a second rotational direction.

12. The toy of claim 9, wherein the first flap defines a head portion of the first configuration, and the second flap defines a lower body portion of the first configuration.

13. The toy of claim 9, wherein the first underlying surface defines a head portion of the second configuration and the second underlying surface defines a lower body portion of the second configuration.

14. The toy of claim 9, wherein the first configuration represents a first character and the second configuration represents a second character that is different in appearance from the first character.

15. A toy comprising:

a body;

a first flap coupled to the body along a first seam and having a first surface defining a portion of a first configuration, the first flap also having a second surface opposite the first surface and defining a portion of a second configuration, the second configuration having a different appearance from the first configuration;

a second flap coupled to the body along a second seam and having a third surface defining a portion of the first configuration, the second flap also having a fourth surface opposite the third surface and defining a portion of the second configuration;

a first underlying surface of the body beneath the first flap defining a portion of the second configuration;

a second underlying surface of the body beneath the second flap defining a portion of the second configuration;

wherein the first flap is rotatable about the first seam from a first position in the first configuration, in which the first surface of the first flap is revealed to view and the second surface opposite the first surface is hidden from view, to a second position in the second configuration, in which the second surface of the first flap is revealed to view and the first surface of the first flap is hidden from view, and wherein the second flap is rotatable about the second seam from a first position in the first configuration, in which the third surface of the second flap is revealed to view and the fourth surface of the second flap is hidden from view, to a second position in the second configuration, in which the fourth surface of the second flap is revealed to view and the third surface of the second flap is hidden from view.

16. The toy of claim 15, wherein an upper portion of the first configuration is at least a portion of a head of a first character, and an upper portion of the second configuration is at least a portion of a head of a second character.

17. The toy of claim 15, wherein the first the flap is rotatable in a first direction from the first configuration to the second configuration and the second flap is rotatable in a second direction opposite to the first direction from the first configuration to the second configuration.

18. The toy of claim 15, wherein the toy is made of plush fabric.

19. The toy of claim 1, wherein the first seam and the second seam together form an overall seam that extends entirely around the body of the toy.

20. The toy of claim 1, wherein the first flap is coupled to the body along the first seam via stitching, and wherein the second flap is coupled to the body along the second seam via stitching.

21. The toy of claim 9, wherein the first seam and the second seam together form an overall seam that extends entirely around the toy.

22. The toy of claim 9, wherein the first flap is coupled to the first portion along the first seam via stitching, and wherein the second flap is coupled to the second portion along the second seam via stitching.

23. The toy of claim 15, wherein the first seam and the second seam together form an overall seam that extends entirely around the body of the toy.

24. The toy of claim 15, wherein the first flap is coupled to the body along the first seam via stitching, and wherein the second flap is coupled to the body along the second seam via stitching.

* * * * *